US009423084B2

(12) United States Patent
Lee et al.

(10) Patent No.: US 9,423,084 B2
(45) Date of Patent: Aug. 23, 2016

(54) INDIRECT LIGHTING APPARATUS

(71) Applicant: Seoul Semiconductor Co., Ltd., Ansan-si (KP)

(72) Inventors: Chung Hoon Lee, Ansan-si (KR); Hyuck Jung Choi, Ansan-si (KR); Eun Ju Kim, Ansan-si (KR); Ji Hye Ahn, Ansan-si (KR)

(73) Assignee: Seoul Semiconductor Co., Ltd., Ansan-si (KR)

( * ) Notice: Subject to any disclaimer, the term of this patent is extended or adjusted under 35 U.S.C. 154(b) by 9 days.

(21) Appl. No.: 14/361,286

(22) PCT Filed: Nov. 27, 2012

(86) PCT No.: PCT/KR2012/010112
§ 371 (c)(1),
(2) Date: May 28, 2014

(87) PCT Pub. No.: WO2013/081351
PCT Pub. Date: Jun. 6, 2013

(65) Prior Publication Data

US 2014/0355293 A1 Dec. 4, 2014

(30) Foreign Application Priority Data

Dec. 1, 2011 (KR) ..... 10-2011-0127545

(51) Int. Cl.
*F21V 13/08* (2006.01)
*F21K 99/00* (2016.01)
(Continued)

(52) U.S. Cl.
CPC ... *F21K 9/56* (2013.01); *F21K 9/52* (2013.01); *F21V 9/16* (2013.01); *F21V 7/0041* (2013.01); *F21Y 2101/02* (2013.01); *F21Y 2103/003* (2013.01)

(58) Field of Classification Search
CPC ..... F21K 9/52; F21K 9/56; F21V 9/16
See application file for complete search history.

(56) References Cited

U.S. PATENT DOCUMENTS 6,373,188 B1 * 4/2002 Johnson ..... H01L 33/505 257/94
2006/0072314 A1 4/2006 Rains
(Continued)

FOREIGN PATENT DOCUMENTS

JP 2001-243821 9/2001
JP 2001243821 A * 9/2001
(Continued)

OTHER PUBLICATIONS

International Search Report dated Feb. 28, 2013 in International Patent Application No. PCT/KR2012/010112.
(Continued)

*Primary Examiner* — Anh Mai
*Assistant Examiner* — Nathaniel Lee
(74) *Attorney, Agent, or Firm* — H.C. Park & Associates, PLC

(57) ABSTRACT

An indirect lighting apparatus includes a light-emitting device, a reflector disposed above the light-emitting device, and a wavelength conversion layer disposed on a surface of the reflector facing the light-emitting device and spaced apart from the light-emitting device. The wavelength conversion layer includes phosphors configured to change the wavelength of light emitted from the light-emitting device. The reflector is configured to reflect light emitted from the wavelength conversion layer, back towards the wavelength conversion layer.

16 Claims, 3 Drawing Sheets

(51) Int. Cl.

| | |
|---|---|
| ***F21V 9/16*** | (2006.01) |
| *F21V 9/02* | (2006.01) |
| *F21V 7/00* | (2006.01) |
| *F21Y 101/02* | (2006.01) |
| *F21Y 103/00* | (2016.01) |

(56) References Cited

U.S. PATENT DOCUMENTS

| | | | | |
|---|---|---|---|---|
| 2011/0001422 | A1* | 1/2011 | Aanegola ..... | H01L 25/0753 313/501 |
| 2011/0227102 | A1 | 9/2011 | Hussell et al. | |

FOREIGN PATENT DOCUMENTS

| | | |
|---|---|---|
| JP | 2008-021932 | 1/2008 |
| KR | 10-0963806 | 6/2010 |
| KR | 10-2011-0108098 | 10/2011 |
| WO | 2011/109093 | 9/2011 |
| WO | 2011-122655 | 10/2011 |

OTHER PUBLICATIONS

Chinese Office Action issued on Feb. 25, 2016, in Chinese Application No. 201280059519.6.

* cited by examiner

INDIRECT LIGHTING APPARATUS

CROSS-REFERENCE TO RELATED APPLICATIONS

This application is the National Stage of International Application No. PCT/KR2012/010112, filed on Nov. 27, 2012, and claims priority from and the benefit of Korean Patent Application No. 10-2011-0127545, filed on Dec. 1, 2011, which are hereby incorporated by reference for all purposes as if fully set forth herein.

BACKGROUND

1. Field

The present invention relates to a lighting apparatus using a semiconductor light emitting device as a light source and, more particularly, to an indirect lighting apparatus.

2. Discussion of the Background

Semiconductor light emitting devices are used for various purposes and have been spotlighted as a light source of a lighting apparatus, due to various advantages thereof, such as rapid response, high energy efficiency, long lifespan, and the like.

A lighting apparatus employing a semiconductor light emitting device typically includes a light emitting diode and phosphors, and realizes white light through combination of colors. For example, white light can be realized by a combination of a blue light emitting diode and yellow phosphors.

In such a general white lighting apparatus, light emitted from a light emitting diode and light subjected to wavelength conversion by phosphors are used for direct lighting. Such a direct lighting apparatus allows light emitted from the light emitting diode and having relatively high intensity to enter the eyes of a user, thereby providing undesirable effects to the user.

In the white lighting apparatus, the semiconductor light emitting device is generally used to emit white light by coating or depositing phosphors onto a light emitting diode chip. However, such a white semiconductor light emitting device is likely to suffer from light loss due to re-entering of light into the light emitting diode chip after being subjected to wavelength conversion by the phosphors.

SUMMARY

The present invention is aimed at providing a lighting apparatus capable of protecting a user, particularly, the eyes of a user.

The present invention is aimed at providing a lighting apparatus capable of reducing light loss due to a light emitting diode chip.

The present invention provides an indirect lighting apparatus. The indirect lighting apparatus includes: a semiconductor light emitting device; a reflector disposed above the semiconductor light emitting device reflector; and a wavelength conversion layer formed on a surface of the reflector and separated from the semiconductor light emitting device. The wavelength conversion layer contains phosphors excited by light emitted from the semiconductor light emitting device and emitting light subjected to wavelength conversion, and the reflector reflects the light received from the wavelength conversion layer towards the wavelength conversion layer.

As used herein, the term "indirect lighting apparatus" is compared with a direct lighting apparatus which is designed to use light directly emitted from a light source such as a semiconductor light emitting device, and means a lighting apparatus designed to reflect light emitted from a light source towards surroundings such that the reflected light can be used for illumination. The indirect lighting apparatus can protect a user by preventing direct exposure of the user to light emitted from the semiconductor light emitting device.

The indirect lighting apparatus may further include a lower filter disposed under the semiconductor light emitting device and filtering light directed to the outside of the indirect lighting apparatus. The lower filter can reflect UV light while allowing transmission of visible light therethrough. For example, the semiconductor light emitting device may include a UV light emitting diode chip. In this case, the lower filter prevents UV light from being emitted to the outside of the indirect lighting apparatus.

The indirect lighting apparatus may further include a diffusing plate disposed below the semiconductor light emitting device. The diffusing plate can mix light emitted from the semiconductor light emitting device with light subjected to wavelength conversion in the wavelength conversion layer by diffusing the light.

The diffusing plate may have a roughness pattern formed on a surface thereof. The roughness pattern may be adopted for extraction of light or for scattering of light.

The wavelength conversion layer may include phosphors emitting different colors, for example, first phosphors and second phosphors.

The phosphors may be mixed with each other, but are not limited thereto. Alternatively, the phosphors may be separated from each other. For example, the wavelength conversion layer may include first phosphor concentrated regions and second phosphor concentrated regions. Alternatively, the wavelength conversion layer may include a first wavelength conversion layer containing first phosphors and a second wavelength conversion layer containing second phosphors. In addition, a band pass filter may be disposed between the first wavelength conversion layer and the second wavelength conversion layer.

In some embodiments, the wavelength conversion layer may be disposed restrictively on some surface region of the reflector. For example, the wavelength conversion layer may be disposed within a beam angle range of the semiconductor light emitting device. In addition, the semiconductor light emitting device may include a semiconductor light emitting diode chip and a phosphor coating layer formed on a side surface of the semiconductor light emitting diode chip.

The semiconductor light emitting device is mounted on a printed circuit board. Here, the printed circuit board is disposed to face the reflector and the semiconductor light emitting device is disposed between the printed circuit board and the reflector.

In addition, a plurality of semiconductor light emitting devices may be mounted on the printed circuit board.

The reflector may have a concave reflective face, like an inner wall of a hemispherical or a hemiellipsoid body, without being limited thereto. Alternatively, the reflector may have an inner wall shape of a hemicylinder.

For example, the printed circuit board may have an elongated shape, the plurality of semiconductor light emitting devices may be arranged in a longitudinal direction of the printed circuit board, and the reflector may have an elongated shape and be disposed above the printed circuit board.

In some embodiments, the printed circuit board may be a light transmitting substrate. Thus, light emitted from the semiconductor light emitting device can pass through the printed circuit board.

The indirect lighting apparatus may further include a second wavelength conversion layer disposed under the printed circuit board and converting wavelengths of light passing through the second wavelength conversion layer.

The indirect lighting apparatus may further include a band pass filter disposed between the printed circuit board and the second wavelength conversion layer to reflect light subjected to wavelength conversion in the second wavelength conversion layer while allowing transmission of light emitted from the semiconductor light emitting device therethrough.

In some embodiments, light emitted from semiconductor light emitting device can be directly incident on the reflector. In other embodiments, light emitted from the semiconductor light emitting device may enter a light guide plate such that light emitted from the light guide plate is incident on the reflector.

According to embodiments of the present invention, indirect lighting is adopted to reduce bad effects of light emitted from the semiconductor light emitting device on human bodies. Furthermore, a wavelength conversion layer is disposed on a reflector to reduce light loss by preventing light subjected to wavelength conversion from re-entering the light emitting diode chip.

DETAILED DESCRIPTION OF THE ILLUSTRATED EMBODIMENTS

Figure 1:
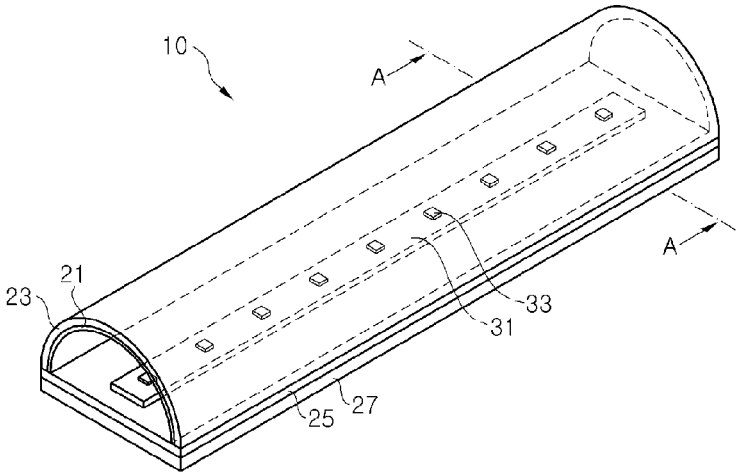
FIG. 1 is a schematic perspective view of a lighting apparatus in accordance with one embodiment of the present invention.

Hereinafter, embodiments of the present invention will be described in more detail with reference to the accompanying drawings. It should be understood that the following embodiments are given by way of illustration only to provide a thorough understanding of the invention to those skilled in the art. Therefore, the present invention is not limited to the following embodiments and may be embodied in different ways. Further, the widths, lengths, and thicknesses of certain elements, layers or features may be exaggerated for clarity. Like components will be denoted by like reference numerals throughout the specification.

Figure 2:
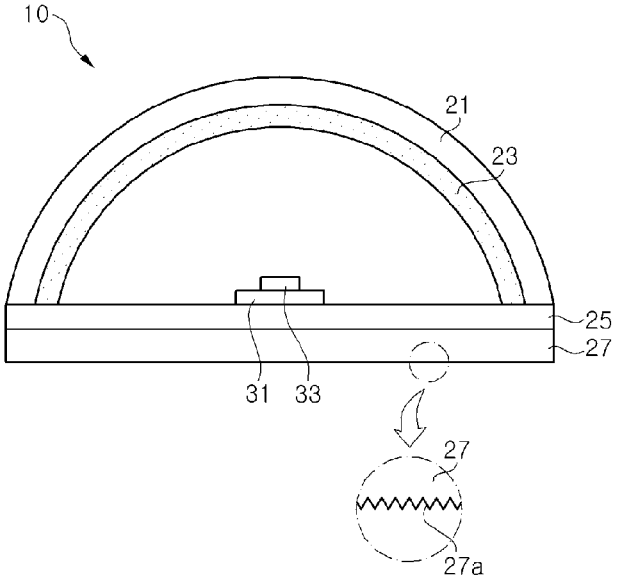
FIG. 2 is a cross-sectional view of the lighting apparatus taken along line A-A of FIG. 1.

FIG. 1 is a schematic perspective view of a lighting apparatus 10 in accordance with one embodiment of the present invention, and FIG. 2 is a cross-sectional view of the lighting apparatus taken along line A-A of FIG. 1.

Referring to FIGS. 1 and 2, the indirect lighting apparatus 10 includes a reflector 21, a wavelength conversion layer 23, a lower filter 25, a diffusing plate 27, a printed circuit board 31, and a semiconductor light emitting device 33.

The printed circuit board 31 has circuits for supplying electric current to the semiconductor light emitting devices. The printed circuit board 31 may have an elongated shape in one direction (longitudinal direction), as shown in FIG. 1.

The semiconductor light emitting device 33 is mounted on the printed circuit board 31. A plurality of semiconductor light emitting devices 33 may be arranged on the printed circuit board 31 in the longitudinal direction thereof. Here, the semiconductor light emitting devices 33 may be packaged light emitting diode chips, without being limited thereto. Alternatively, the semiconductor light emitting devices 33 may be light emitting diode chips.

The semiconductor light emitting devices 33 include gallium nitride-based light emitting diode chips and may emit UV light or blue light. In addition, an AlGaInP or AlGaInAs-based green or red light emitting diode chip may be additionally mounted on the printed circuit board 31.

The reflector 21 is disposed above the semiconductor light emitting devices 33. The semiconductor light emitting devices 33 are disposed between the printed circuit board 31 and the reflector 21 to emit light towards the reflector 21. The reflector 21 may have a reflective face, which is concave in one direction, like an inner wall of a cylinder, and extends in the longitudinal direction of the printed circuit board 31, as shown in FIG. 1. The reflector 21 is disposed above the printed circuit board 31 and reflects light emitted from the semiconductor light emitting devices 33.

The reflector 21 may be prepared by forming a metal plate such as an aluminum plate, without being limited thereto. Alternatively, the reflector 21 may be prepared by coating a reflective layer onto a metal or plastic molded article. The reflective layer may be formed of any material capable of reflecting light emitted from the semiconductor light emitting devices 33 and the wavelength conversion layer 23.

The wavelength conversion layer 23 is provided to a surface of the reflector 21. Accordingly, the wavelength conversion layer 23 is separated from the semiconductor light emitting devices 33. The wavelength conversion layer 23 may contain phosphors excited by light emitted from the semiconductor light emitting devices 33 and emitting light having a long wavelength. Furthermore, the wavelength conversion layer 23 may contain plural kinds of phosphors emitting different colors.

The lower filter 25 is disposed under the semiconductor light emitting devices 33 and filters light directed to the outside of the indirect lighting apparatus 10. For example, the lower filter 25 reflects UV light while allowing transmission of visible light therethrough. Accordingly, when the semiconductor light emitting devices 33 include a UV light emitting diode chip to emit UV light, it is possible to prevent UV light, which is not subjected to wavelength conversion by the wavelength conversion layer 23, from being emitted outside the indirect lighting apparatus 10.

The diffusing plate 27 is disposed below the semiconductor light emitting devices 33, for example, under the lower filter 25. The diffusing plate 27 mixes light emitted outside the indirect lighting apparatus 10 by diffusing the light. Further, the diffusing plate 27 may have a roughness pattern 27*a* formed on a light exit face thereof. The roughness pattern 27*a* may be formed to enhance extraction efficiency of light emitted from the diffusing plate 27 or to scatter the light.

According to this embodiment, the semiconductor light emitting devices 33 are disposed below a central region of the reflector 21 and light reflected by the reflector 21 is directed towards lower sides of the semiconductor light emitting devices 33. Here, most light emitted from semiconductor light emitting devices 33 is subjected to wavelength conversion by the phosphors in the wavelength conversion layer 23, and light emitted from the phosphors is directed in all directions without a particular beam orientation. As a result, since the phosphors are separated from the semiconductor light emitting devices 33, it is possible to reduce light loss due to re-entrance of wavelength-converted light into the semiconductor light emitting devices 33.

Figure 3:
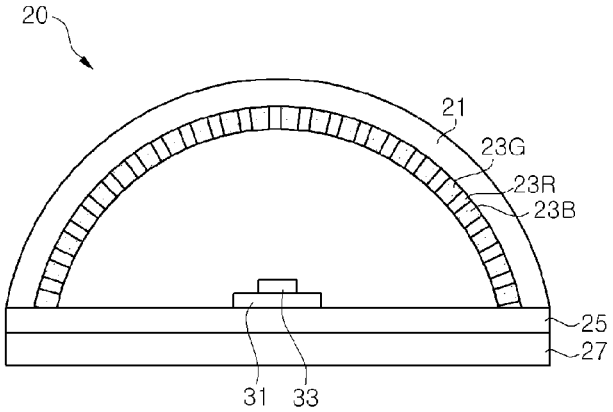
FIG. 3 to FIG. 8 are cross-sectional views of lighting apparatuses in accordance with other embodiments of the present invention.

FIG. 3 is a cross-sectional view of an indirect lighting apparatus 20 in accordance with another embodiment of the present invention.

Referring to FIG. 3, the indirect lighting apparatus 20 according to this embodiment is generally similar to the indirect lighting apparatus 10 of FIGS. 1 and 2 except that the wavelength conversion layer of the indirect lighting apparatus 20 includes a blue phosphor concentrated region 23B, a green phosphor concentrated region 23G, and a red phosphor concentrated region 23R.

Specifically, in this embodiment, the phosphors emitting different colors are separated from each other, instead of being mixed with each other. Such concentrated regions 23R, 23G, 23B may be formed by dotting or screen printing.

Thus, it is possible to prevent color spots due to uneven mixing of the phosphors or to prevent formation of defective products due to difference in mixing ratio of the phosphors.

Figure 4:
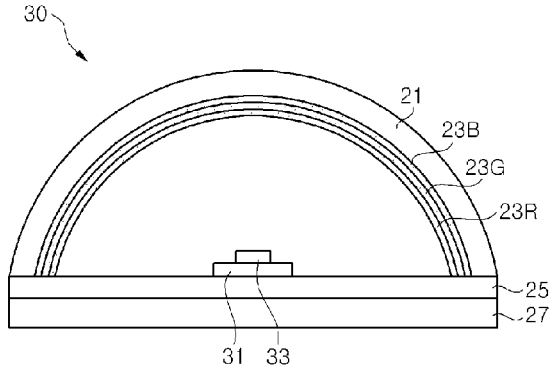

FIG. 4 is a cross-sectional view of an indirect lighting apparatus 30 in accordance with a further embodiment of the present invention.

Referring to FIG. 4, the indirect lighting apparatus 30 according to this embodiment is generally similar to the indirect lighting apparatus 10 of FIGS. 1 and 2 except that the wavelength conversion layer of the indirect lighting apparatus 30 is composed of a plurality of wavelength conversion layers converting light into different colors.

Specifically, in this embodiment, the wavelength conversion layer may include a blue wavelength conversion layer 23B that emits blue light, a green wavelength conversion layer 23G that emits green light, and a red wavelength conversion layer 23R that emits red light, which are stacked one above another.

Here, the wavelength conversion layer that emits light having a relatively short wavelength is disposed closer to the reflector 21 than the other wavelength conversion layers. That is, the wavelength conversion layers are stacked in order of the blue wavelength conversion layer 23B, the green wavelength conversion layer 23G and the red wavelength conversion layer 23R from the reflector 21. With this structure, it is possible to minimize loss of light subjected to wavelength conversion by one wavelength conversion layer due to the other wavelength conversion layers.

In this embodiment, the semiconductor light emitting devices 33 may emit UV light. On the other hand, when the semiconductor light emitting devices 33 emit blue light, the blue wavelength conversion layer 23B can be omitted.

Figure 5:
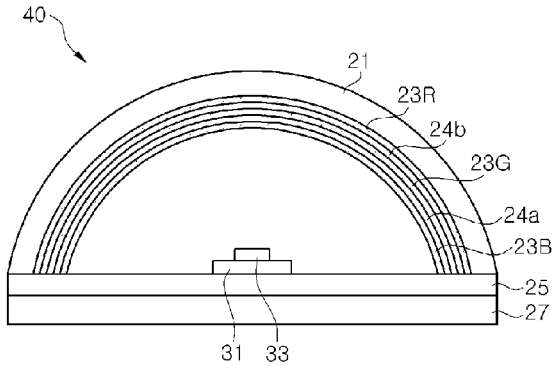

FIG. 5 is a cross-sectional view of an indirect lighting apparatus 40 in accordance with yet another embodiment of the present invention.

Referring to FIG. 5, the indirect lighting apparatus 40 according to this embodiment is generally similar to the indirect lighting apparatus 10 of FIGS. 1 and 2 except that the wavelength conversion layer of the indirect lighting apparatus 40 is composed of a plurality of wavelength conversion layers 23B, 23G, 23R, which convert light into different colors, and band pass filters 24*a*, 24*b*.

Specifically, in this embodiment, the wavelength conversion layer may include a blue wavelength conversion layer 23B that emits blue light, a green wavelength conversion layer 23G that emits green light, a red wavelength conversion layer 23R that emits red light, and the band pass filters 24*a*, 24*b* disposed between these wavelength conversion layers. Here, the wavelength conversion layer that emits light having a relatively long wavelength is disposed closer to the reflector 21 than the other wavelength conversion layers. That is, the wavelength conversion layers are stacked in order of the red wavelength conversion layer 23R, the green wavelength conversion layer 23G and the blue wavelength conversion layer 23B from the reflector 21.

On the other hand, a first band pass filter 24*a* is disposed between the blue wavelength conversion layer 23B and the green wavelength conversion layer 23G, and a second band pass filter 24*b* is disposed between the green wavelength conversion layer 23G and the red wavelength conversion layer 23R. The first band pass filter 24*a* reflects blue light while allowing transmission of green and red light therethrough. In addition, the second band pass filter 24*b* reflects green light while allowing transmission of red light therethrough. Furthermore, when the semiconductor light emitting devices 33 emits UV light, the first and second band pass filters 24*a*, 24*b* allow transmission of UV light therethrough.

In this embodiment, the wavelength conversion layer that emits light having a relatively long wavelength is illustrated as being disposed closer to the reflector 21 than the other wavelength conversion layers. However, the wavelength conversion layers may be disposed in reverse order. That is, the wavelength conversion layers are stacked in order of the blue wavelength conversion layer 23B, the green wavelength conversion layer 23G and the red wavelength conversion layer 23R from the reflector 21. In this case, the first band pass filter 24*a* is disposed between the red wavelength conversion layer 23R and the green wavelength conversion layer 23G to reflect red light while allowing transmission of blue and green light therethrough. In addition, the second band pass filter 24*b* is disposed between the green wavelength conversion layer 23G and the blue wavelength conversion layer 23B to reflect green light while allowing transmission of blue light therethrough.

According to this embodiment, the first and second band pass filters 24*a*, 24*b* are adopted to reflect light, which has been subjected to wavelength conversion, thereby preventing light loss due to absorption of the wavelength converted light into the other kinds of phosphors.

Figure 6:
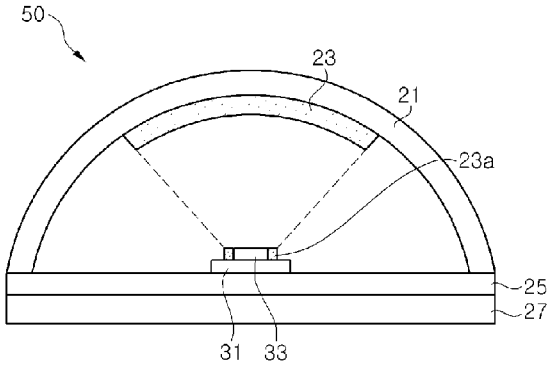

FIG. 6 is a cross-sectional view of an indirect lighting apparatus 50 in accordance with yet another embodiment of the present invention.

Referring to FIG. 6, the indirect lighting apparatus 50 according to this embodiment is generally similar to the indirect lighting apparatus 10 of FIGS. 1 and 2 except that the wavelength conversion layer 23 is defined on some region of the reflector 21.

That is, in the indirect lighting apparatus 10 of FIGS. 1 and 2, the reflector 21 is disposed to reflect any light emitted from side and upper surfaces of the semiconductor light emitting device 23. However, the semiconductor light emitting devices 33 generally emit most light within a certain beam angle to the outside.

Accordingly, in this embodiment, the wavelength conversion layer 23 may be generally disposed within a beam angle range of light emitted from the semiconductor light emitting devices 33, thereby enabling reduction in amounts of the phosphors.

Further, when the semiconductor light emitting devices 33 are light emitting diode chips, a phosphor coating layer 23*a* may be formed on a side surface of each of the light emitting diode chips to prevent direct reflection of light by the reflector 21 after being emitted from the side surface of each of the light emitting diode chips 33. Such a phosphor coating layer 23*a* may be partially formed on the side surface of the light emitting diode chip by conformal coating.

Figure 7:
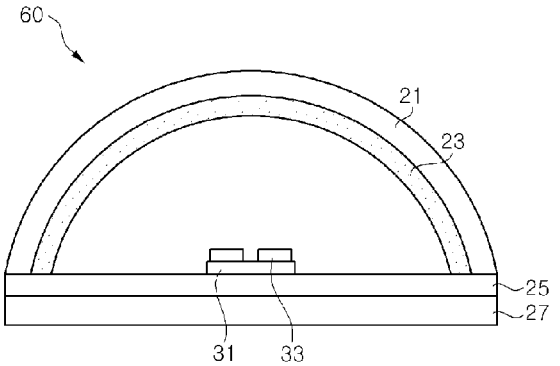

FIG. 7 is a cross-sectional view of an indirect lighting apparatus 60 in accordance with yet another embodiment of the present invention.

Referring to FIG. 7, the indirect lighting apparatus 60 according to this embodiment is generally similar to the indirect lighting apparatus 10 of FIGS. 1 and 2 except that two rows of semiconductor light emitting devices 33 are arranged on the printed circuit board 31 in the indirect lighting apparatus 60.

That is, although the semiconductor light emitting devices 33 are arranged in the longitudinal direction of the printed circuit board 31 as shown in FIG. 1, the semiconductor light emitting devices 33 are arranged in plural rows.

In this embodiment, the plural rows of semiconductor light emitting devices 33 are arranged on a single printed circuit board 31. However, it should be understood that the present invention is not limited thereto. In other embodiments, a plurality of printed circuit boards 31 each having the semiconductor light emitting devices 33 mounted thereon may be arranged parallel to each other.

Figure 8:
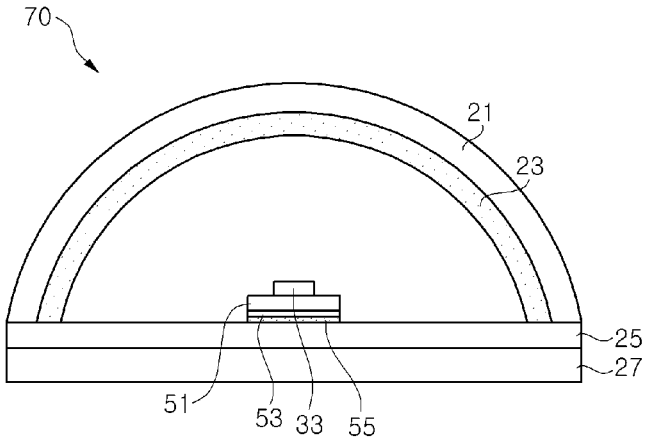

FIG. 8 is a cross-sectional view of an indirect lighting apparatus 70 in accordance with yet another embodiment of the present invention.

Referring to FIG. 8, the indirect lighting apparatus 70 according to this embodiment is generally similar to the indirect lighting apparatus 10 of FIGS. 1 and 2 except that a printed circuit board 51 of the indirect lighting apparatus 70 is a light transmitting substrate.

That is, according to this embodiment, the printed circuit board 51 may be fabricated as a light transmitting substrate, such as a glass substrate, a quartz substrate, and the like. In addition, substrates of various light transmitting materials, for example, a resin substrate or a ceramic substrate, may be used as the printed circuit board. A printed circuit may be partially formed on such a substrate of a light transmitting material.

The semiconductor light emitting devices 33 are provided in the form of light emitting diode chips and may be attached to an upper surface of a printed circuit board 51 via a light transmitting adhesive. Accordingly, light emitted from the semiconductor light emitting devices 33 can be discharged to the outside through the printed circuit board 51.

A second wavelength conversion layer 55 may be disposed below the printed circuit board 51. The second wavelength conversion layer 55 is excited by light passing through the printed circuit board 51 such that wavelength-converted light is emitted from the second wavelength conversion layer 55. The second wavelength conversion layer 55 contains phosphors as in the wavelength conversion layer 23.

A band pass filter 53 may be disposed between the second wavelength conversion layer 55 and the semiconductor light emitting devices 33. The band pass filter 53 reflects the wavelength-converted light emitted from the second wavelength conversion layer 55 while allowing transmission of light emitted from the semiconductor light emitting devices 33 therethrough. Accordingly, it is possible to prevent light loss by preventing the light subjected to wavelength conversion by the second wavelength conversion layer 55 from re-entering the semiconductor light emitting devices 33.

Figure 9:
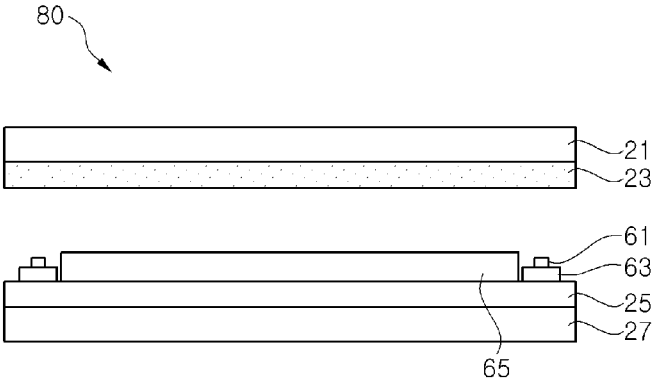
FIG. 9 is a side sectional view of a lighting apparatus in accordance with yet another embodiment of the present invention.

FIG. 9 is a side sectional view of an indirect lighting apparatus 80 in accordance with yet another embodiment of the present invention.

Referring to FIG. 9, the indirect lighting apparatus 80 further includes a light guide member 65 unlike the above embodiments.

Semiconductor light emitting devices 61 are disposed on side surfaces of the light guide member 65. The semiconductor light emitting devices 61 may be mounted on a printed circuit board 63. For example, the semiconductor light emitting devices 61 may be lateral type light emitting diodes, without being limited thereto. The semiconductor light emitting devices 61 emit light towards the side surfaces of the light guide member 65. On the other hand, the light guide member 65 discharges light towards the reflector 21 after receiving the light from the semiconductor light emitting devices 61.

In this embodiment, the light guide member 65 may have an elongated bar shape and light reflected by the reflector 21 may be discharged downwards through the opposite sides of the light guide member 65.

According to this embodiment, it is possible to provide the lighting apparatus capable of illuminating a wide area using a relatively small number of semiconductor light emitting devices 65 by adopting the light guide member 65.

Although some embodiments have been described above, it should be understood that some features of a certain embodiment may also be applied to other embodiments without departing from the spirit and scope of the invention. In addition, it should be understood that the present invention is not limited to the embodiments described above, and that various modifications, variations, and alterations can be made without departing from the spirit and scope of the invention.

The invention claimed is:

1. An indirect lighting apparatus, comprising:

a light-emitting device comprising a semiconductor;

a reflector disposed above the light-emitting device; and a first wavelength conversion layer disposed on a surface of the reflector facing the light-emitting device and spaced apart from the light-emitting device, wherein:

the first wavelength conversion layer comprises first and second phosphors configured to change the wavelength of light emitted from the light-emitting device, the first and second phosphors configured to emit different wavelengths of light;

the reflector is configured to reflect light emitted from the first wavelength conversion layer, back towards the first wavelength conversion layer; and the first phosphors are confined to a first layer of the first wavelength conversion layer;

the second phosphors are confined to a second layer of the first wavelength conversion layer; and the first wavelength conversion layer further comprises a band pass filter disposed between the first layer and the second layer.

2. The indirect lighting apparatus of claim 1, further comprising:

a lower filter disposed under the light-emitting device, the lower filter configured to reflect ultraviolet (UV) light and transmit visible light.

3. The indirect lighting apparatus of claim 2, further comprising a diffusing plate disposed on the lower filter.

4. The indirect lighting apparatus of claim 3, wherein the diffusing plate comprises a roughness pattern formed on a surface thereof.

5. The indirect lighting apparatus of claim 1, wherein:

the first layer is configured to emit light having a shorter wavelength than the second layer; and the first layer is disposed farther from the reflector than the second layer.

6. The indirect lighting apparatus of claim 1, wherein:

the first layer is configured to emit light having a shorter wavelength than the second layer; and the first layer is disposed closer to the reflector than the second layer.

7. The indirect lighting apparatus of claim 1, wherein the first wavelength conversion layer covers a portion of an inner surface of the reflector.

8. The indirect lighting apparatus of claim 7, wherein the first wavelength conversion layer is disposed within a beam angle range of the light-emitting device.

9. The indirect lighting apparatus of claim 7, further comprising a second wavelength conversion layer, wherein the light-emitting device is a semiconductor light-emitting diode chip, and the second wavelength conversion layer is disposed on a side surface of the semiconductor light-emitting diode chip.

10. The indirect lighting apparatus of claim 1, further comprising a printed circuit board (PCB) upon which the light-emitting device is disposed.

11. The indirect lighting apparatus of claim 10, further comprising an additional light-emitting device disposed on the PCB.

12. The indirect lighting apparatus of claim 11, wherein:

the PCB has an elongated shape;

the light-emitting devices are disposed along a longitudinal direction of the PCB; and the reflector comprises an elongated shape and is disposed above the PCB.

13. The indirect lighting apparatus of claim 10, wherein the PCB comprises a light-transmitting substrate.

14. The indirect lighting apparatus of claim 13, further comprising an additional wavelength conversion layer disposed under the PCB.

15. The indirect lighting apparatus of claim 14, further comprising a band pass filter disposed between the PCB and the additional wavelength conversion layer, wherein the band pass filter is configured to reflect light emitted from the additional wavelength conversion layer and transmit light emitted from the light-emitting device.

16. The indirect lighting apparatus of claim 1, further comprising a light guide member configured to guide light emitted from the light-emitting device towards the reflector.

* * * * *